United States Patent [19]

Coté

[11] 4,039,273

[45] Aug. 2, 1977

[54] PHOTOFLASH LAMP PROVIDING AFTER-FLASH SHORTING

[75] Inventor: Paul T. Coté, Cleveland Heights, Ohio

[73] Assignee: General Electric Company, Schenectady, N.Y.

[21] Appl. No.: 571,264

[22] Filed: Apr. 24, 1975

[51] Int. Cl.[2] ..... F21K 5/02

[52] U.S. Cl. ..... 431/95 R; 431/95 A

[58] Field of Search ..... 431/93, 94, 95 A, 95 R

[56] References Cited

U.S. PATENT DOCUMENTS

| | | | |
|---|---|---|---|
| 3,528,354 | 9/1970 | Nakagawa | 431/95 X |
| 3,552,896 | 1/1971 | Kuhlmann | 431/95 |
| 3,556,699 | 1/1971 | Takahashi et al. | 431/95 |

*Primary Examiner*—Alan Cohan
*Assistant Examiner*—Gerald A. Michalsky
*Attorney, Agent, or Firm*—Norman C. Fulmer; Lawrence R. Kempton; Frank L. Neuhauser

[57] ABSTRACT

A photoflash lamp having a pair of lead-in wires arranged within the lamp so that one wire extends laterally above the other and is of a size and material so as to deform due to heat of the flashing lamp and make contact with the other wire.

15 Claims, 6 Drawing Figures

PHOTOFLASH LAMP PROVIDING AFTER-FLASH SHORTING

CROSS-REFERENCE TO RELATED APPLICATION

Ser. No. 567,576, filed Apr. 14, 1975, Vaughn C. Sterling and Lewis J. Schupp, "Multiple Flash Lamp System," assigned the same as the present invention.

BACKGROUND OF THE INVENTION

The invention is in the field of photoflash lamps of the electrically fired type and designed to provide a short circuit, or relatively low impedance, across its lead-in wires after the lamp has been flashed.

U.S. Pat. No. 3,532,931 to Paul Cote and John Harnden shows, in FIGS. 1 and 2, a type of flash lamp sequencing circuit utilizing switches that are normally open (or high impedence) and which close (or change to low impedance) upon flashing of the lamps, and the lamps must have open circuits (or high impedance) across their lead-in wires after flashing. FIG. 3 of the same patent shows a different type of flash lamp sequencing circuit, in which switches (such as fuses) initially have a low impedance and become open-circuited (or high impedance) upon flashing of the lamps, and the lamps must become electrically shorted (or have a low impedance) across their lead-in wires upon flashing. The same patent describes the alternatives of employing lamps in the FIG. 3 circuit which reliably short upon flashing, and/or connecting switch devices across the lamps to achieve the same result in the sequencing circuit. U.S. Pat. No. 3,692,995 to Karl Wagner also shows a flash lamp sequencing circuit which employs openings switches and shorting lamps, and describes a type of shorting lamp in which the electrodes melt together. The above-referenced patent application discloses a shorting lamp construction having a primer material, between the lead-in wires in the lamp, which ignites combustible material in the lamp in response to a firing voltage pulse, and the primer material thereupon forms a conductive residue which provides a short circuit, or relatively low impedance, across the lead-in wires.

The lamps described above can be the so-called high voltage type of lamp which can be fired by a low energy voltage pulse of about 100 volts or more, and frequently in the range of about 1000 to 3000 volts such as can be produced by impacting a piezoelectric element. U.S. Pat. Nos. 2,972,937 and 3,106,080 to C. G. Suits disclose a high voltage flash lamp and a piezoelectric firing arrangement.

SUMMARY OF THE INVENTION

Objects of the invention are to provide new and improved flash lamps of the shorting type and which exhibit low impedance across the lead-in wires after the lamp has flashed.

The invention comprises, briefly and in a preferred embodiment, a photoflash lamp comprising a bulb, and having a pair of lead-in wires arranged within said bulb so that one wire extends laterally over the other and is of a size and shape to deform from heat of the lamp when it flashes and descend by gravity into contact with the other lead-in wire. Primer material can be applied between the wires such as across the vertical preflash gap between the lead-in wires. The lower lead-in wire can be laterally shaped crosswise under the upper lateral wire to increase the reliability of the wires shorting when the lamp is flashed. Still further, the upper wire can be shaped to form a loop over the lower wire, and/or can be flattened in cross-sectional shape to increase the reliability of after-flash shorting.

DESCRIPTION OF THE PREFERRED EMBODIMENTS

Figure 1:
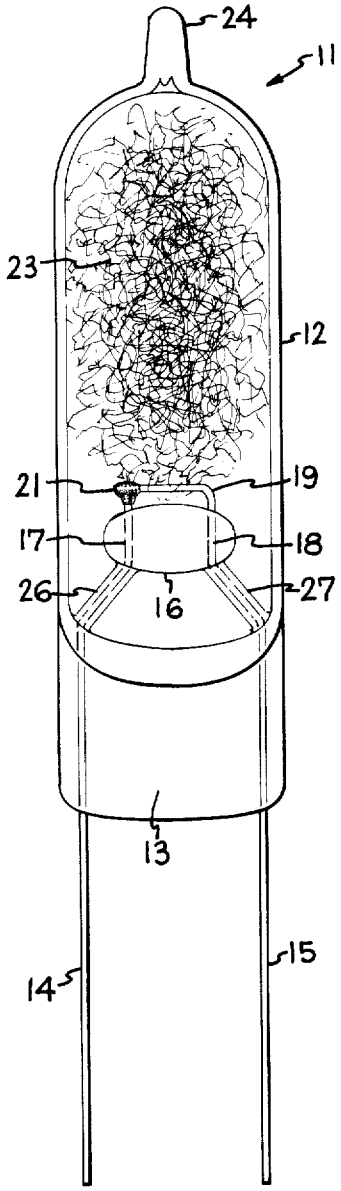
FIG. 1 is a side view of a photoflash lamp in accordance with a preferred embodiment of the invention.
Figure 2:
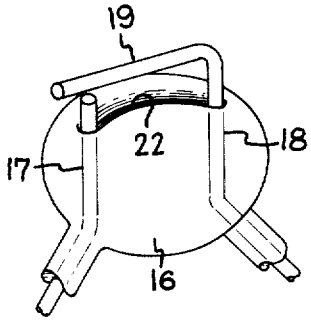
FIGS. 2 and 3 are perspective views of the mount structure in the lamp of FIG. 1, respectively before and after the lamp has been flashed.

The lamp 11 shown in FIG. 1 of the drawing may be, except for construction of the mount, generally the same as described in U.S. Pat. No. 3,816,054 to John Baldrige and John Sobieski, and comprises a tubular envelope 12, preferably made of a borosilicate glass or other suitable vitreous material having a stem press seal 13 at one end thereof through which a pair of lead-in wires 14, 15 extend from the exterior to the interior of the bulb 12 in a generally mutually parallel spaced-apart manner. A bead 16 of glass or other suitable vitreous material secures the in-lead portions 17 and 18 of the lead-in wires 13 and 14 in spaced-apart relationship with respect to each other within the bulb 12. The inlead 17 extends a short distance above the top of the bead 16, and the inlead 18 extends up and laterally over and above and spaced from the upper end of the inlead 17, as indicated by numeral 19. This spacing may be small, such as about 10 to 50 thousandths of an inch. Primer material 21 extends between the inleads 17 and 18. A relatively small amount of primer material 21 may be positioned in the gap above the inlead 17, as shown, or the primer material 21 may be arranged to engulf the entire parts of the inleads 17 and 18 that are exposed above the top of the bead 16. Alternatively, a layer of primer material 21 may be coated on top of the bead and extending between and in contact with the inleads 17 and 18. To facilitate the latter, an elongated groove 22 may be provided in the top surface of the bead 16, extending from one to the other of the inleads 17 and 18, as shown in FIG. 2.

To complete the flash lamp 11, in the embodiment shown, the bulb 12 is partly or substantially filled with a loose mass of filamentary or shredded foil or wire 23 of zirconium or hafnium or other suitable combustible metal. Air is exhausted from the bulb 12, and the bulb is filled with oxygen at a pressure of at least several atmospheres, such as about 5 to 10 atmospheres, and the bulb is sealed off at an exhaust tip 24 at the upper end thereof. The lamp may be coated with usual lacquer or plastic protective coating. The portions of the inleads 17 and 18 between the bead 16 and the seal 13 may be coated with glass 26 and 27, respectively, or other electrically insulating material, to prevent any loose pieces of the filamentary metal 23, which may settle at the bottom of the bulb, from electrically shorting between the inleads 17 and 18 so as to prevent the lamp from flashing. Also, care should be taken that the filamentary metal 23 does not short across exposed of the inleads 17 and 18 above the bead 16. This may be achieved by properly positioning the filamentary mass of material 23, or by coating exposed parts of the inleads with electrically insulating material, or by coating the entire exposed parts thereof with primer material 21, or by covering the exposed portion of at least one of the inleads 17 and 18 with electrically insulating material.

The primer material 21 may comprise a porous mixture of a readily ignitable metallic powder such as zirconium or a mixture of zirconium with magnesium, and an oxidizing agent such as potassium perchlorate, bonded together by a suitable binder such as nitrocellulose, all as disclosed in the above-referenced Suits patents. The lamp shown in FIG. 1 may be flashed by a suitable source of electrical energy applied across the lead-in wires 14 and 15, such as by a burst of electrical energy generated by a piezoelectric element, as disclosed in the above-referenced Suits patents. A plurality of the lamps 11 may be arranged in a photoflash multiple exposure lamp array containing suitable switching circuitry so that one lamp becomes flashed by each firing pulse, as disclosed in the above-referenced patent application. A firing pulse applied to the lead-in wires 14 and 15 causes the primer 21 to ignite, which ignites the filamentary metal 23, which burns with support of the oxygen in the bulb and causes the flash of light.

In accordance with the invention, the laterally extending portion 19 of the inlead 18 is made of such dimensions (length and diameter) and of such a material that it deforms and sags or descends by gravity due to being heated from the heat generated by the burning filamentary metal 23 when the lamp is flashed, so that it sags or falls against and into contact with the other inlead 17, thereby resulting in a lamp that is electrically shorted, or which has a relatively low electrical resistance across its lead-in wires 14 and 15, after being flashed, thus meeting the requirement described above for shorting types of lamps in one type of electrically switched sequential flashing lamp array, and as further described in the above-referenced patent application.

It is customary for the flash lamps in multiple flash units, such as flashcubes and the FlashBar array, to be arranged so that when they are attached to the camera the lamps will be in base-down condition when flashed, i.e., with the relative thick and heavy seal portion 13 at the bottom of the bulb. This is done partially so that falling hot metal fragments will strike the relatively thick base and seal region 13 of the bulb and will be less likely to crack the bulb than if these hot fragments were to fall on the relatively thinner side wall or top portion of the bulb. Thus, the description of a laterally extending portion of an inlead extending above and spaced from the other inlead is with respect to the orientation of the lamp bulb when flashing.

The material of the lead-in wires 14 and 15 will be chosen, at least in part, by their coefficient of thermal expansion with respect to that of the glass of the bulb 12. For the above-described borosilicate hard glass, suitable lead-in wire material is known by the names Kovar, Rodar, Fernico, among others. Generally, these are alloys predominantly of iron, nickel, and cobalt. Therefore, after selecting lead-in wire material that is compatible with the glass of the envelope 12, the laterally extending portion 19 of inlead 18 is dimensioned to function properly when the lamp is flashed, as has been described. The laterally inlead portion 19 will become deformed in response to heat more readily as its lateral length is increased, and as its diameter is decreased. It will also be more sensitive to heat deformation if it is flattened, as will be described with reference to FIG. 5. On the other hand, the lateral portion 19 of the inlead 18 must not be so sensitive to heat that it will be likely to melt sufficiently to become severed when the lamp flashes.

Figure 3:
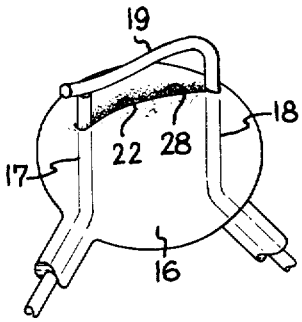

After-flash shorting of the lamp will be facilitated, in certain lamps, by unburned or partly burned metal foil debris 27 falling into the groove 22 and bridging across the inleads 17 and 18, as shown in FIG. 3. In FIG. 3, the laterally extending portion 19 of the inlead 18 is shown in a deformed position, resting against the top of the other inlead 17, which is approximately optimum, i.e., the lateral protion 19 has deformed and fallen sufficiently to insure its resting against the inlead 17, yet has not become heated sufficiently to the point where it was likely to become melted and severed. If some of the debris 27 of unburned or partly burned metal should intervene between the top of the inlead 17 and deformed lateral portion 19 of the other inlead 18, the lamp will be likely to have sufficiently low internal resistance to permit proper functioning of the switching circuitry, and the upper lateral inlead extension will in effect have fallen into contact with the other inlead wire in accordance with the invention.

Figure 4:
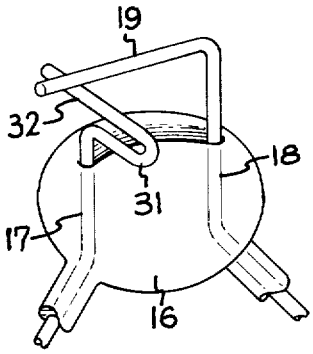
FIG. 4 is a prespective view of an alternative mount construction, in accordance with another preferred embodiment of the invention.

While the mount shown in FIGS. 1, 2, and 3 will function properly to provide a shorted or low impedance lamp after flashing, if the lamp is in a substantially vertical and base-down position, as is customary in multiple flash lamp units, the mount arrangement of FIG. 4 insures that the lamp will be shorted or of low impedance even though it may be tilted from the base-down condition when flashed. This is achieved by shaping the inlead 17, above the bead 16, so that it extends laterally underneath and crosswise with respect to the lateral portion 19 of the inlead 18. As shown in FIG. 4, this can be accomplished by bending the inlead 17 a distance in one direction, giving it a U-bend 31, and extending it laterally underneath the portion 19 in a cross-wise manner, as indicated by numeral 32. Thus, if the lamp is tilted when flashed and the lateral deformable portion 19 does not fall directly toward the inlead 17, it will come to rest on its cross-lateral portion 32, thus achieving the shorted after-flash condition desired. Since the cross-lateral inlead portion 32 is farther down from the main heat of combustion of the flashing lamp, it will not be so likely to deform as the deformable lateral extension 19. However, if desired, the inlead 17 may be made of a higher temperature material than that of inlead 18, or inlead 17 could be a larger diameter than inlead 18, or the laterals extension 19 of inlead 18 can be flattened or tapered or narrowed down, to achieve proper heat deformation and after-shorting of a flashed lamp. Also, the lateral member 19 can be a length of material attached to the inlead 18 to function as a lateral extension of the inlead having the proer heat deformation characteristics. Another precaution that can be taken to achieve proper functioning is to arrange the cross-lateral extension 32 on the tope surface of the bead 16, or so near this surface that even if it does deform and drop slightly it will still be contacted by the deforming and falling extension arm 19 of inlead 18.

Figure 5:
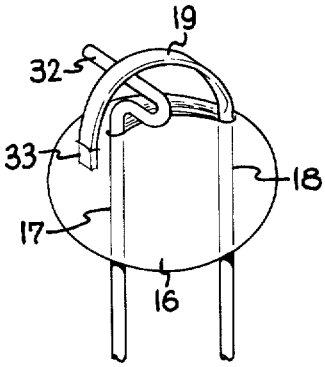
FIGS. 5 and 6 are perspective views of an alternative mount construction, both before and after the lamp has been flashed, in accordance with a still further preferred embodiment of the invention.
Figure 6:
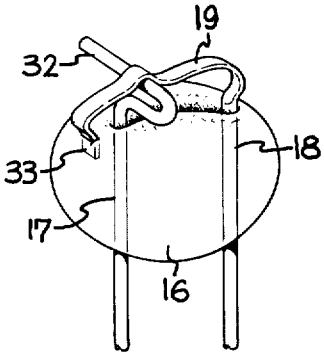

In the after-flash short circuit mount construction shown in FIGS. 5 and 6, of which FIG. 5 is before flashing of the lamp, the inlead 17 is shaped to form a cross-lateral extension 32, as has been shown in FIG. 4. However, the lateral overlying extension 19 of inlead 18 has been flattened horizontally, as shown, and its free end is sealed or otherwise attached to the glass bead 16 as indicated at 33. Thus, the upper lateral inlead section 19 forms a loop arcing over and around the cross-lateral member 32 of the other inlead. The heat of combustion of the flashing lamp causes the upper lateral member 19 to deform and collapse down toward and/or against the cross-lateral member 32, as shown in FIG. 6, thus causing a short-circuit condition of the flashed lamp, as is desired for the purpose of this invention. It can be seen that the embodiment of FIGS. 5 and 6 will cause the desired shorted condition of a flash lamp, even though the lamp is considerably off the vertical position, and can be even sideways, and the upper lateral inlead extension 19, since it is captivated at both ends to the bead 16, may hve a certain amount of lateral (with respect to the lamp's axis) movement as it deforms, and it will contact against the inlead cross-lateral extension 32 to provide an after-flash shorted or low impedance condition. Also, flattening of the upper deformable lateral member 19 in the manner shown, i.e., so that it is substantially thicker from side to side than it is from top to bottom, it will be less likely to swing sideways toward one or the other ends of the cross-lateral member 32 when falling, thus insuring it will come to rest on the lower cross member 32, as shown in FIG. 6.

The type of mount shown in FIG. 5 can be modified so that shorting will occur when the lamp is flashed in any position including a base-up position, by making the cross member 32 so that it deforms and falls due to heat of the flashing lamp. When the lamp is flashed in base-up position, the member 32 will fall, by gravity, against the loop member 19, which will also fall a bit by gravity, but only a limited amount due to both of its ends being held by the bead 16. When such a lamp is flashed in the normal base-down position, any falling by gravity of the member 32 will be checked by the top surface of the bead 16, and the member 19 will fall against the member 16 to provide the desired after-flash low impedance.

The invention can be useful in combination with the shorting lamp arrangement of the above-referenced patent application to further insure after-flash shorting or low impedance of flashed lamps.

While preferred embodiments of the invention have been shown and described, various other embodiments and modifications thereof will become apparent to persons skilled in the art and will fall within the scope of the invention as defined in the following claims.

What I claim as new and desire to secure by Letters Patent of the United States is:

1. A shorting type of photoflash lamp comprising a bulb, first and second inlead wires extending into said bulb, and combustible material within said bulb which is capable of producing light and heat when the lamp is flashed, wherein the improvement comprises an arrangement in which said first inlead wire extends laterally above and spaced from said second inlead wire and is of a size and material to deform from heat of the lamp when it flashes and descend by gravity into contact with said other inlead wire and provide a short-circuit between said inlead wires after the lamp is flashed.

2. A flash lamp as claimed in claim 1, including an ignition member comprising primer material between and in contact with both of said inleads.

3. A flash lamp as claimed in claim 1, in which said second inlead extends laterally below and crosswise with respect to said lateral extension of the first inlead.

4. A flash lamp as claimed in claim 1, in which said lateral extension of the first inlead has a flattened cross section having greater horizontal width than vertical height.

5. A flash lamp as claimed in claim 1, in which said lateral extension of the first inlead is shaped in the form of a loop arcing over said second inlead.

6. A flash lamp as claimed in claim 5, including means holding both ends of said loop in fixed position with respect to said second inlead.

7. A flash lamp as claimed in claim 6, in which said second inlead extends laterally through the plane of said loop of the first inlead.

8. A flash lamp as claimed in claim 6, in which said loop of the first inlead has a flattened cross section having greater horizontal width than vertical height.

9. A flash lamp as claimed in claim 1, including a bead of vitreous material sealed around said inleads within said bulb, said laterals extension of the first inlead being spaced above said bead.

10. A flash lamp as claimed in claim 9, in which said inleads are substantially mutually parallel and extend substantially vertically through said bead, and a groove in the top of said bead extending between said inleads.

11. A flash lamp as claimed in claim 9, in which said lateral extension of the first inlead has a flattened cross section having greater horizontal width than vertical height.

12. A flash lamp as claimed in claim 9, in which said second inlead extends laterally below and crosswise with respect to said lateral extension of the first inlead.

13. A flash lamp as claimed in claim 12, in which said lateral extension of the first inlead is shaped in the form of a loop arching over said lateral extension of the second inlead.

14. A flash lamp as claimed in claim 13, in which both ends of said loop are attached to said bead.

15. A flash lamp as claimed in claim 13, in which said loop of the first inlead has a flattened cross section having greater horizontal width than vertical height.

* * * * *